United States Patent [19]

Ruetschle et al.

[11] Patent Number: 4,499,834

[45] Date of Patent: Feb. 19, 1985

[54] REJECT ASSEMBLY FOR SHEET MATERIAL HANDLING APPARATUS

[75] Inventors: Rudolph H. Ruetschle; John W. Raker, both of Elyria, Ohio

[73] Assignee: Harris Graphics Corporation, Melbourne, Fla.

[21] Appl. No.: 448,432

[22] Filed: Dec. 10, 1982

[51] Int. Cl.[3] ..... D05B 23/00

[52] U.S. Cl. ..... 112/2; 112/121.11; 112/121.15; 112/147; 112/262.3; 112/304; 270/53; 209/656; 209/576; 209/552

[58] Field of Search ..... 112/2, 121.11, 121.12, 112/121.15, 152, 147, 262.1, 262.3, 303, 304; 209/656, 576, 552; 270/53, 54, 56

[56] References Cited

U.S. PATENT DOCUMENTS

| | | | |
|---|---|---|---|
| Re. 29,105 | 1/1977 | Miaskoff et al. | 270/56 |
| 3,038,606 | 6/1962 | Leaver et al. | 209/576 |
| 3,554,531 | 1/1971 | Heigl | 270/53 |
| 3,561,752 | 2/1971 | McCain et al. | 270/56 |
| 3,664,655 | 5/1972 | McCain et al. | 270/53 |
| 4,386,768 | 6/1983 | Heinz | 270/53 |

*Primary Examiner*—Ronald Feldbaum
*Attorney, Agent, or Firm*—Yount & Tarolli

[57] ABSTRACT

An apparatus for sequentially stitching groups of sheets includes a reject assembly which directs groups of sheets containing either more or less than a predetermined number of sheets to a receiving station without being stitched. If a desired number of sheets is in a group, the group will move through the reject station to a stitching station and then through a folding apparatus at one of two discharge stations. The reject assembly includes a ramp which is movable between a retracted position aligned with a main support surface and an extended position projecting upwardly from the main support surface to a reject conveyor. A main conveyor pushes a group of sheets containing more or less than a predetermined number of sheets up the ramp to a reject conveyor which conducts the groups of sheets to a receiving station. To facilitate setting up of the apparatus, the reject assembly is operated to either reject all of the groups of sheets or none of the groups of sheets depending upon whether or not it is desired to move the groups of sheets through the stitching station.

17 Claims, 6 Drawing Figures

REJECT ASSEMBLY FOR SHEET MATERIAL HANDLING APPARATUS

BACKGROUND OF THE INVENTION

The present invention relates to collators, and particularly to collators operable to stitch groups of sheets containing a selected number of sheets and to reject groups of sheets containing more or less than the selected number of sheets.

A known collator includes a plurality of hoppers which are disposed in a linear array along a main conveyor assembly. The main conveyor assembly sequentially moves groups of sheets received from the hoppers to a transfer station where the groups of sheets are sequentially engaged by a shuttle assembly. The shuttle assembly moves each group of sheets in turn to a stitching station where the group of sheets is either saddle, side or corner stitched. Each group of sheets is then moved from the stitching station through a folding station. After a group of sheets is folded, it moves to an upper discharge station. If a group of sheets is not to be folded, it passes to a lower discharge station. This known machine is disclosed in U.S. Pat. No. 3,554,531.

The machine shown in U.S. Pat. No. 3,554,531 has been improved by using a conveyor belt assembly to move groups of sheets to and from a stitching station. The conveyor belt assembly has upper and lower runs which grip the groups of sheets. This structure is disclosed in pending U.S. patent application Ser. No. 234,923, now U.S. Pat. No. 4,386,768 filed Feb. 17, 1981 by Victor A. Zugel and entitled "Signature Feeding And Stitching Method And Apparatus".

The machines shown in U.S. Pat. No. 3,554,531 and in pending application Ser. No. 234,923, now U.S. Pat. No. 4,386,768 when built and sold commercially incorporated a mechanism for sensing if a particular group of sheets contained more or less than a selected number of sheets. If a particular group of sheets was defective, i.e., included more or less than the selected number, the machine would stop to allow the defective group to be removed from the machine. This results in slowing the output of the machine.

Also, when the existing machines are being set up for a given job, such as adjustments being made to the hoppers, groups of sheets would travel completely through the machine. The sheets of such groups generally end up as waste, since the sheets are distorted or otherwise damaged due to their passing through the machine.

SUMMARY OF THE PRESENT INVENTION

The present invention relates to a collator of the general type disclosed in U.S. Pat. 3,554,531 and pending U.S. application Ser. No. 234,923, now U.S. Pat. No. 4,386,768. The collator of the present invention may have a higher output and be set up with less waste material.

The collator of the present invention includes a support surface which extends past a plurality of hoppers to a stitching station. Sheets are sequentially fed from the hoppers to form groups of sheets on the support surface. A main conveyor assembly sequentially pushes groups of sheets along the support surface to a reject station. Groups of sheets containing more or less than a predetermined number of sheets are rejected at the reject station. The groups of sheets containing the predetermined number of sheets are moved to a transfer station where they are engaged by a secondary conveyor assembly which moves them to a stitching station.

At the reject station, a ramp is movable between a retracted position and an extended position. When the reject ramp is in the retracted position, it cooperates with the main support surface to support groups of sheets containing the predetermined number of sheets as they sequentially move to the stitching station. When the ramp is in the extended postion, it projects upwardly from the main support surface to a reject conveyor. The main conveyor assembly pushes groups of sheets containing more or less than the predetermined number of sheets up the reject ramp to the reject conveyor.

During operation of the collator of the present invention, because of the reject ramp, it is unnecessary to stop the machine when a defective group of sheets is encountered. This allows for a greater output from the machine.

Moreover, when the machine of the present invention is being set up for a given job, it is unnecessary for the groups of sheets to be transmitted through the machine. Specifically, a control is incorporated in the machine which enables the reject ramp to reject all material which is being conveyed by the main conveyor assembly. Thus, the groups of sheets may be intentionally moved up the reject ramp, rather than transverse through the entire machine. As a result, the sheets in the groups may not be damaged and may be reused. The control is also constructed so that the collator may operate and no material be rejected. This mode of operation is used when adjustments are being made to the folder section and the stitcher section of the machine.

BRIEF DESCRIPTION OF THE DRAWINGS

Other features of the present invention will become more apparent upon a consideration of the following description of a preferred embodiment of the present invention taken in connection with the accompanying drawings wherein.

DESCRIPTION OF ONE SPECIFIC Preferred Embodiment of the Invention

General Description

Figure 1:
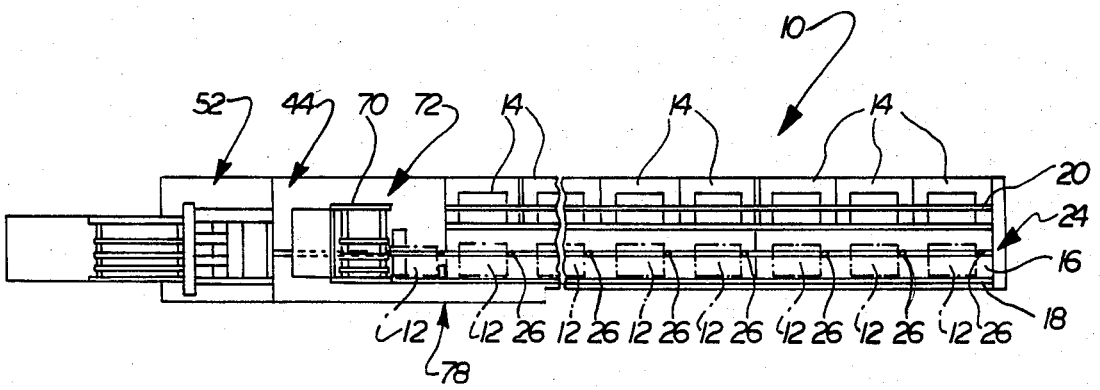
FIG. 1 is a schematic plan view of a sheet material handling apparatus constructed in accordance with the present invention.
Figure 2:
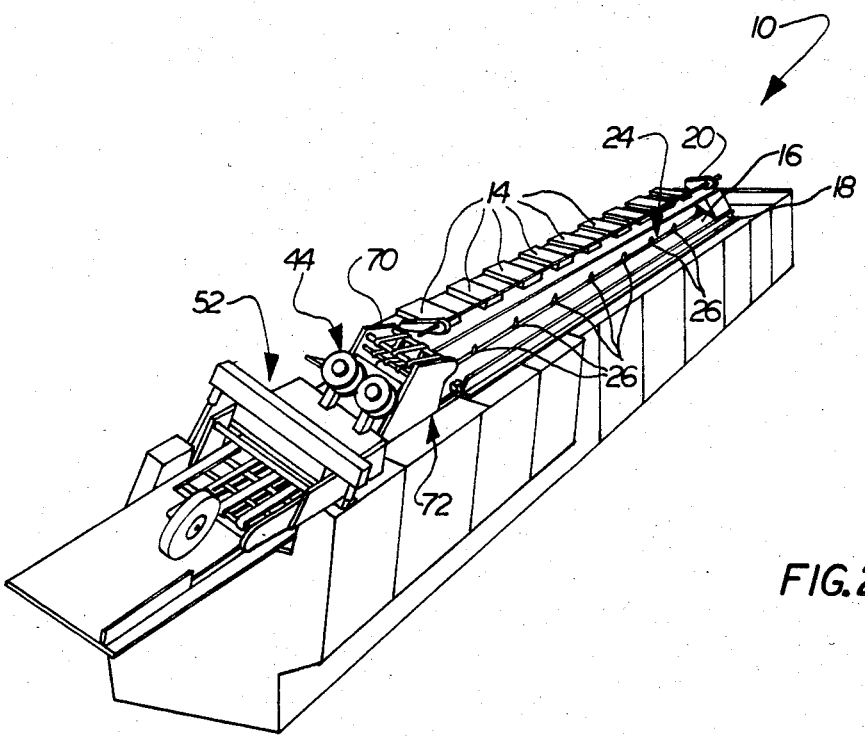
FIG. 2 is a pictorial illustration of the sheet material handling apparatus of FIG. 1.

An apparatus 10 for collating groups of sheets 12 is illustrated in FIGS. 1 and 2. The apparatus 10 includes a supply means for supplying sheets of material. The supply means comprises a plurality of sheet material supply hoppers 14. The hoppers 14 are disposed in a linear array along a support means which is a surface 16 which slopes downwardly away from the hoppers to a guide rail 18. A sheet feed mechanism 20 is provided to feed sheets from each of the hoppers 14 onto the support surface 16.

A main conveyor assembly 24 is provided to sequentially move the groups of sheets 12 along the support surface 16 past each of the hoppers 14. The main conveyor assembly 24 includes a plurality of pusher fingers 26 which project upwardly from the support surface 16 and engage the trailing edges of each of the groups of sheets 12 to push them along the support surface 16 (see FIGS. 2 and 3). The pusher fingers 26 are connected with a continuous chain 30 (FIG. 5) having an upper run which extends past each of the hoppers 14 to a transfer station 32 (see FIG. 3) where the sheets are transferred from the main conveyor 24 to a secondary conveyor 36.

The secondary conveyor assembly 36 includes upper and lower belts 40 and 42 (FIGS. 3 and 5) which engage the leading edge portion of a group of sheets at the transfer station 32 and accelerate the groups of sheets away from a pusher finger 26 to a stitching station 44. During movement from the transfer station 32 to the stitching station 44, the group of sheets is clamped between the upper and lower belts 40 and 42 of the secondary conveyor 36 to hold the sheets against movement relative to each other. Shortly before the sheets are positioned relative to a stapling apparatus 48 at the stitching station 44, the upper belt 40 is moved upwardly away from the lower belt 42 to release the sheets.

Figure 5:
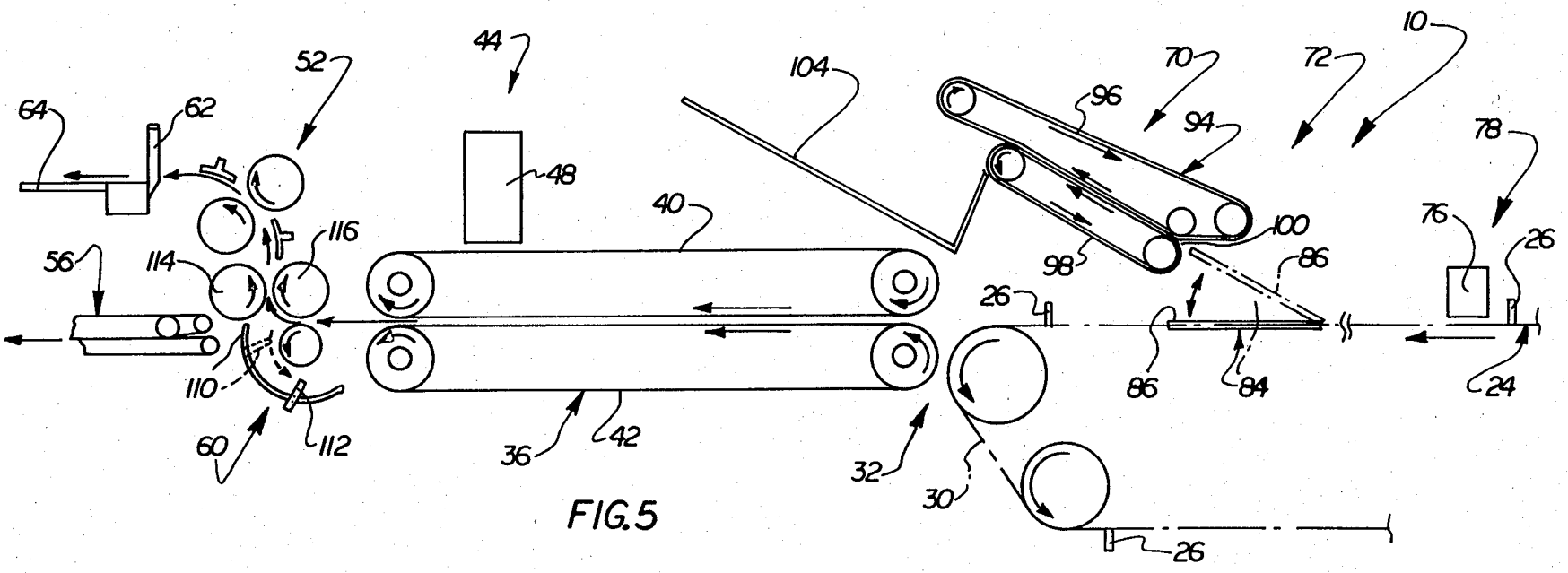
FIG. 5 is a schematic illustration depicting the relationship between the reject assembly, a pair of belts for moving a signature to the stitching station, and a folder assembly.

A register finger (not shown) then engages the trailing edge portions of the released sheets to register the sheets relative to the stitching apparatus 48. The sheets are then stitched and again clamped by the belts 40 and 42. The belts 40 and 42 move the sheets to a folding station 52 (FIG. 5). The manner in which each group of sheets is clamped by the belts 40 and 42 and then released and registered at the stitching station 44 is the same as disclosed in U.S. patent application Ser. No. 234,923, filed Feb. 17, 1981 by Victor A. Zugel and entitled "Signature Feeding And Stitching Method and Apparatus".

At the stitching station 44, the groups of sheets are either saddle, side or corner stitched. If a group of sheets is corner or side stitched, the group of sheets moves through the folding station 52 to a lower discharge conveyor assembly 56 (FIG. 5) without being folded. However, if a group of sheets is saddle stitched, at the stitching station 44, the group of sheets is folded by a buckle folder assembly 60 and trimmed by a knife 62 at the folding station 52 and then moved to an upper discharge conveyor assembly 64. The general construction and mode of operation of the buckle folder 60 and trimming knife 62 is the same as is disclosed in U.S. Pat. Nos. 3,554,531 and 3,627,305.

In accordance with a feature of the present invention, a reject assembly 70 is provided at a reject station 72 (see FIGS. 2, 3 and 5) located between the hoppers 14 and stitching station 44. The reject assembly 70 receives groups of sheets containing more or less than a predetermined number of sheets so that these incorrectly formed groups of sheets do not pass through the stitcher assembly 48 and folder 60. By using the reject assembly 70 to receive groups of sheets having either more or less than a predetermined number of sheets, it is not necessary to stop operation of the sheet material handling apparatus 10 and remove the incorrectly formed groups of sheets. Of course, this increases the output of the sheet material handling apparatus 10.

A caliper assembly 76 is provided at an inspection station 78 (FIG. 3) which is disposed immediately before the reject station 72. The caliper assembly 76 detects whether a group of sheets being moved by the main conveyor assembly 24 contains (i) a desired number of sheets or (ii) more or less than the desired number of sheets. If the caliper assembly 76 detects the desired number of sheets in a group, the group of sheets passes through the reject station 72 to the transfer station 32 and stitching station 44. However, if a group of sheets contains either more or less than the desired number of sheets, the reject assembly 70 removes the group of sheets from the stream of sheets moving toward the stitching station 44.

Reject Assembly

Figure 3:
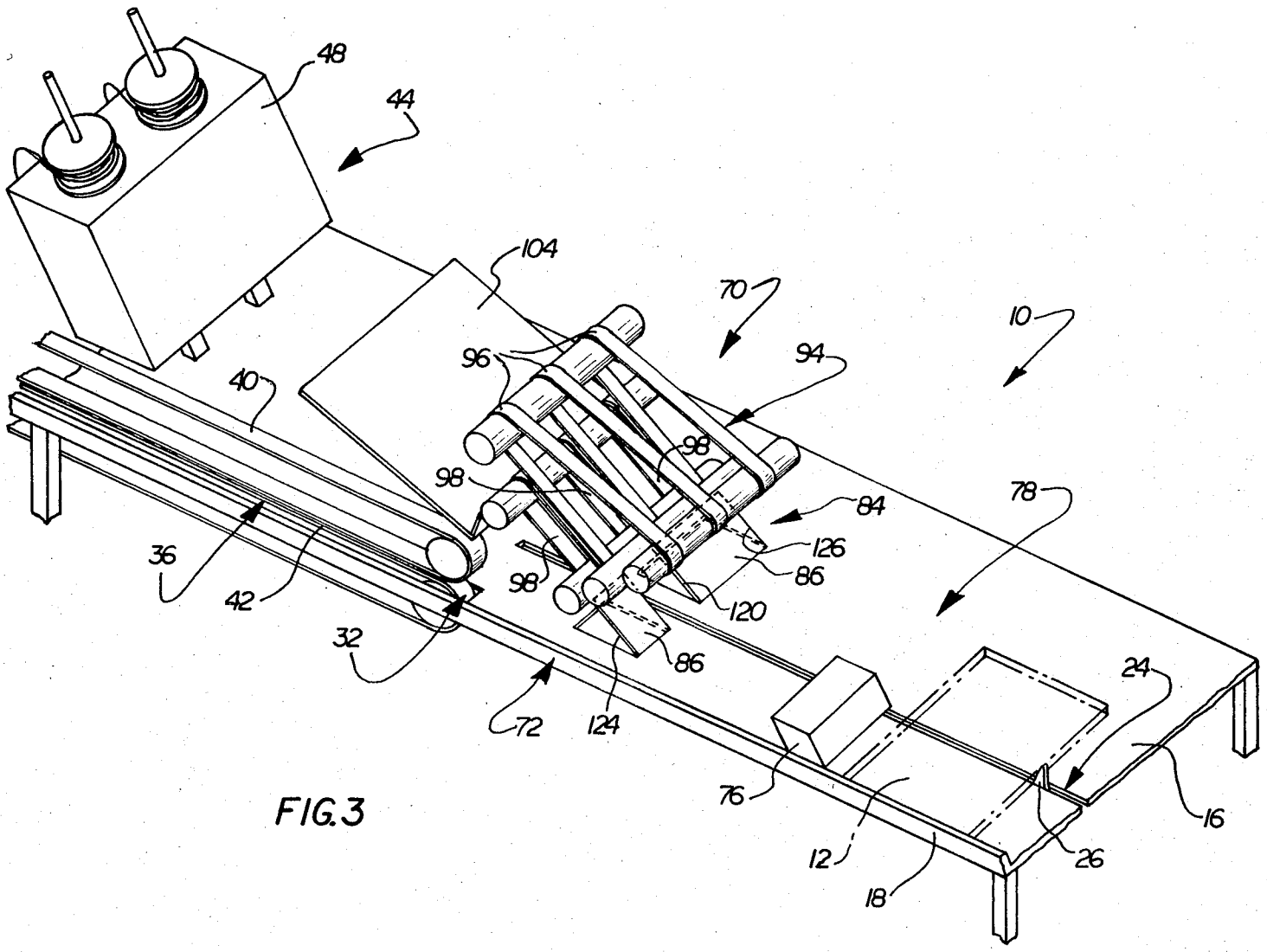
FIG. 3 is a simplified schematic illustation of a portion of the sheet material handling apparatus of FIG. 2 and depicting the relationship between a reject assembly, and a stitcher assembly.
Figure 4:
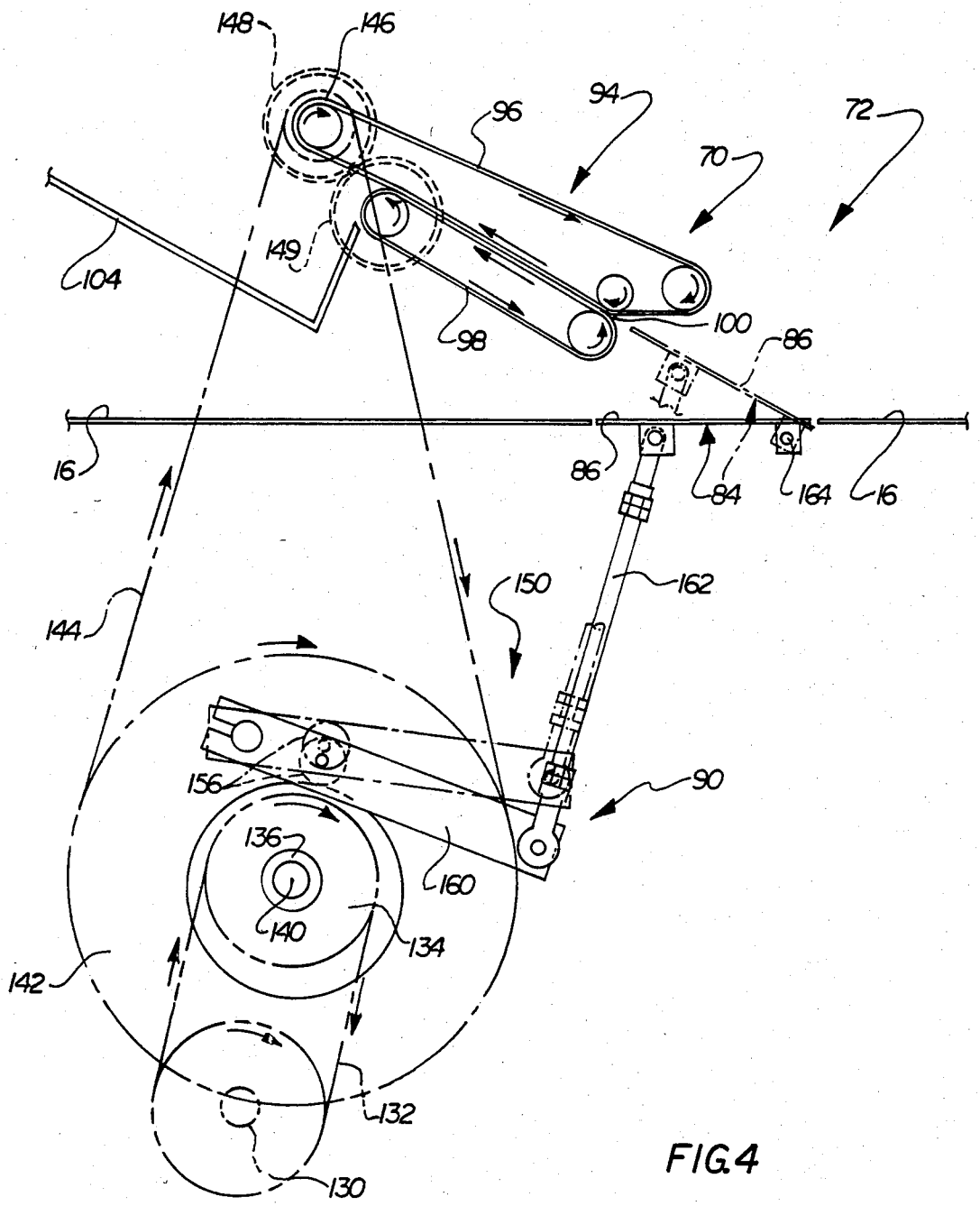
FIG. 4 is an enlarged schematic illustration depicting an apparatus for moving a ramp in the reject assembly between a retracted position and an extended position.

The reject assembly 70 includes a reject ramp 84 which is movable between a retracted position shown in solid lines in FIGS. 4 and 5 and extended position shown in dashed lines in FIGS. 4 and 5. As best shown in FIG. 3, the reject ramp 86 includes two portions located on opposite sides of the path of pushers 26. These enable both wide and narrow sheets to be readily rejected by the ramp.

When the reject ramp 84 is in the retracted position, the upper side 86 of the reject ramp 84 is in a coplanar relationship with the main support surface 16. Therefore, when a group of sheet containing a predetermined number of sheets is moved through the reject station 72 by the main conveyor 24, the reject ramp 84 cooperates with the main support surface 16 to support the group of sheets.

When the caliper assembly 76 detects that a group of sheets contains more or less than a desired number of sheets, a ramp actuator assembly 90 (see FIG. 4) moves the reject ramp 84 from the retracted or lowered position shown in solid lines in FIG. 4 to the raised or extended position shown in dashed lines in FIG. 4. When the reject ramp 84 is in the raised position, the ramp extends upwardly from the main support surface 16 to a reject conveyor assembly 94. The reject conveyor assembly 94 includes a plurality of upper belts 96 which cooperate with a plurality of lower belts 98 to define an inlet nip 100 (see FIG. 4) adjacent to the upper end of the raised reject ramp 84.

When a group of sheets containing either more or less than a predetermined of sheets is to be moved along the main support surface 16 by pusher finger 26, the ramp 84 is raised and the pusher finger moves the groups of sheets up the ramp. As the improperly formed group of sheets move up the reject ramp 84, the leading end portion of the group of sheets enters the nip 100 between the belts 94 and 96. Belts 94 and 96 move in the direction of the arrows in FIG. 4 at a surface speed which is greater than the speed at which the pusher fingers 26 moves the improperly formed group of sheet 12 along the main support surface 16. Therefore, when a group of sheets containing more or less than the predetermined number of sheets enters the nip 100, the group of sheets is accelerated and moved away from the pusher finger.

The improperly formed group of sheets is discharged onto a support bin or tray 104. Since the group of sheets discharged onto the support tray 104 has not been stapled and/or folded, the sheets can be redistributed to the hoppers 14 and subsequently used to form a group of sheets containing the desired number of sheets.

It is preferred to have the reject ramp 84 move upwardly from a coplanar relationship with the main support surface 16 to an upwardly projecting extended position. This is because the ramp 84 can be moved from the retracted position to the extended position while a group of sheets having either more or less than a predetermined number of sheets is being moved onto the ramp by the main conveyor assembly 24. Similarly, the reject ramp 84 can move through at least a portion of the distance from the extended position to the retracted position with a portion of a group of sheets containing a desired number of sheets on the ramp. This tends to maximize the amount of time available for the reject ramp 84 to be moved between the retracted and extended positions. However, it is contemplated that the ramp 84 could be moved downwardly from a retracted position in which the ramp is disposed above the support surface 16.

Operation

When the sheet material handling apparatus 10 is being operated to sequentially stitch groups of sheets, a pusher finger 26 moves from the right end (as viewed in FIGS. 1 and 2) of the support surface 16 past each of the hoppers 14 toward the reject station 72 which is disposed between the hoppers 14 and the stitching station 44. As a pusher finger 26 moves past each of the hoppers 14 in turn, the sheet feed assembly 20 is operated to feed a sheet from the hopper onto the support surface 16 immediately ahead of the pusher finger. Therefore as the pusher finger 26 moves along the support surface 16, a group of sheets is accumulated ahead of the pusher finger. If it is desired to assemble a group of sheets containing a smaller number of sheets than the number of hoppers 14, some of the hoppers could be left empty and the sheet feed mechanism rendered ineffective to feed sheets from the empty hoppers.

After the pusher finger 26 has moved past each of the hoppers 14, the group of sheets is pushed into the inspection station 78 (FIG. 5). The caliper assembly 76 then senses the thickness of the group of sheets to determined whether or not there is a desired number of sheets in the group of sheets. Assuming that the desired number of sheets is in the group of sheets, the reject ramp 84 remains in the retracted position shown in solid lines in FIG. 5. The pusher finger 26 then pushes the group of sheets along the main support surface 16 over the upper side 86 of the reject ramp 84 which is disposed in a coplanar relationship with the main support surface 16.

After the correctly formed group of sheets has been pushed through the reject station 72, it enters the transfer station 32 where the group of sheets is engaged by the secondary conveyor assemby 36 and moved to the stitching station 44. At the stitching station 44, the group of sheets is either saddle, side or corner stitched. Assuming that the group of sheets is saddle stitched, the buckle folder 60 (FIG. 5) is set for the size of the sheets and a gate 110 is closed to block movement of the sheets to the lower discharge conveyor assembly 56. The group of sheets then enters the buckle folder 60 and a leading edge of the group of sheets engages a stop 112. A fold is then formed in a known manner at a nip between a pair of rollers 114 and 116. The molded group of sheets is then trimmed by the knife 62 and moved to an upper discharge conveyor 64.

If a group of sheets is corner or side stitched at the stitching station 44, the group of sheets is not folded. Therefore, when sheets are being either side or corner stitched, the folder gate 110 is moved from the closed position shown in solid lines in FIG. 5 to the open position shown in dashed lines in FIG. 5. This results in saddle or side stitched groups of sheets moving through the folder 60 to the lower discharge conveyor 56 without being folded.

If a group of sheets being pushed by a finger 26 to the inspection station 78 contains more of less than the desired number of sheets, the caliper assembly 76 provides an output signal. This signal causes the ramp actuator assembly 90 to move the reject ramp 84 from the retracted position shown in solid lines in FIG. 4 to the extended position shown in dashed lines in FIG. 4. The pusher finger 26 then pushes the improperly formed group of sheets up the ramp 84 into the nip 100 formed between the belts 96 and 98. The belts 96 and 98 move the improperly formed group of sheets to the receiving tray 104.

The belts 96 and 98 are driven at a surface speed which is greater than the speed at which the pusher finger 26 is moved by the chain 30 (FIG. 5) of the main conveyor assembly 24. Therefore, the group of sheets is moved upwardly away from the pusher finger 26. The pusher finger 26 then moves through an opening 120 (FIG. 3) formed between rectangular sections 124 and 126 of the reject ramp 84. Therefore, the pusher finger moves through the reject station 72 to the transfer station 32 without pushing an improperly formed group of sheets to the transfer 32.

When the caliper assembly 76 detects that a group of sheets having more or less than a predetermined number of sheets is being moved toward the reject station 72 by a pusher finger 26, a signal from the caliper assembly renders the stitcher assembly 48 ineffective to feed wire to staple on the next succeeding cycle of operation. Since the group of sheets which would normally enter the stitching station 44 in the next succeeding cycle is retained at the reject station 72, there will not be any sheets at the stitching station 44 for the stitcher assembly 48 to stitch on the next succeeding cycle of operation. Since the signal from the caliper assembly 76 rendered the stitcher assembly 48 ineffective to feed wire, unused staples are not accumulated at the stitcher assembly during the next operating cycLe. Although the stitcher assembly 48 could be disabled in many different ways, it is contemplated that it will be disabled by energizing a solenoid to shift a wire feed dog in a manner similar to that shown in U.S. Pat. No. 3,561,752.

Ramp Actuator Assembly

The ramp actuator assembly 90 (FIG. 4) moves the ramp 86 between the retracted and extended positions. The ramp actuator assembly 90 is driven from a continuously rotating main drive shaft 130 by a chain 132. When a single revolution clutch assembly, shown schematically at 136, is actuated, drive forces are transmitted from a sprocket 134 to rotate a shaft 140 through one revolution. The drive shaft 140 is connected with a sprocket 142 and chain 144 which drives the belts 96 and 98 of the reject conveyor assembly 94 through a sprocket 146 and gears 148 and 149.

Rotation of the drive shaft 140 (FIG. 4) also effects actuation of a linkage 150 to move the ramp 84 from the retracted position to the extended position. Thus, a cam 152 connected with the shaft 140 is rotated through a single revolution with the shaft each time the clutch 136 is actuated. As the cam 152 rotates, a cam follower 156 moves upwardly to, pivot a lever 160 in a counterclockwise direction (as viewed in FIG. 4) and move an actuator arm 162 upwardly. Upward movement of the actuator arm 162 pivots the reject ramp 84 in a clockwise direction (as viewed in FIG. 4) about a pivot connection 164. This results in the reject ramp 84 being moved to its extended position.

After the group of sheets has been moved up the ramp 84 to the reject conveyor assembly 94, continued rotation of the drive shaft 140 through a single revolution causes the cam follower 156 to move downwardly. Therefore the reject ramp 84 is pivoted in a counterclockwise direction (as viewed in FIG. 4). At the end of a single revolution of the drive shaft 140, the reject ramp 84 is back at the retracted position shown in solid lines in FIG. 4 and the improperly formed group of sheets has been moved to the reject tray 104.

Since the chain 144 is driven only when the single revolution clutch assembly is actuated, it should be clear that the belts 94, 96 are only then driven. This contributes to safety and part longevity and reduces noise.

Assuming that the next succeeding groups of sheets is of the correct size, the single revolution clutch 136 is not engaged. Therefore, rotation of the sprocket 134 by the chain 132 is not transmitted to the shaft 140 and the reject ramp 84 remains in the retracted position shown in FIG. 4.

The single revolution clutch 136 has a construction such that if it is actuated part way through one cycle of operation of the collator 10, the clutch is not engaged until the beginning of the next succeeding cycle. Therefore upon detection of an improperly formed group of sheets, a signal from the caliper assembly 76 energizes a solenoid which actuates the one-way clutch 136 part way through one cycle of operation of the collator 10. However, the clutch itself does not become effective to drive the shaft 140 until the beginning of the next succeeding cycle. Although the one-way clutch 136 could have many different constructions, the preferred clutch is the "CB-6" one-way clutch sold by the Warner Electric Brake & Clutch Company of Beloit, Wisconsin.

Control Circuitry

Figure 6:
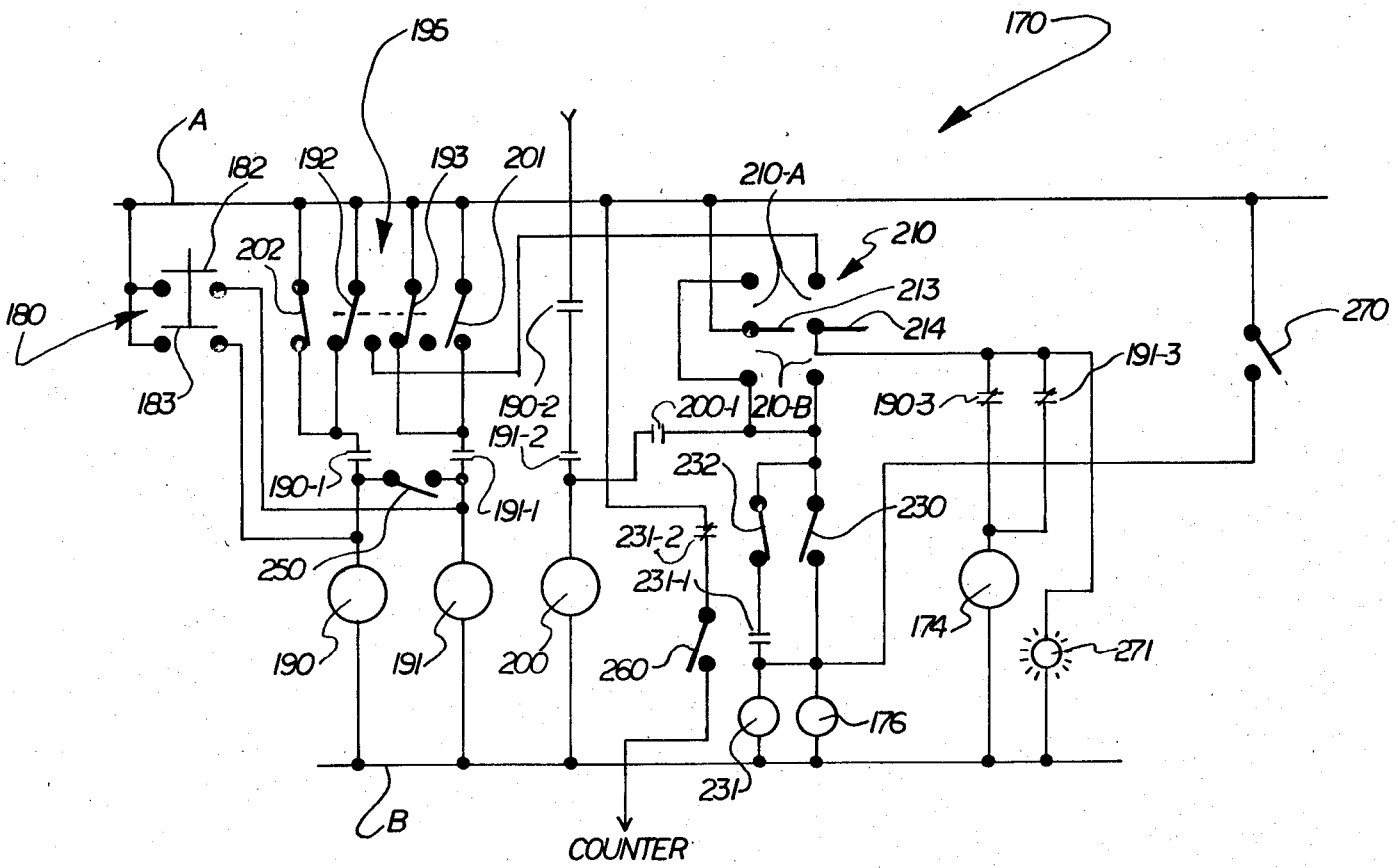
FIG. 6 is a schematic illustration of a control circuit used in the apparatus.

A control circuit 170 for the collator of the present invention is illustrated schematically in FIG. 6. The control circuit 170 includes a solenoid 174 which is energized to actuate the single revolution clutch 136. A stitcher feed disabling solenoid 176 is energized to render the stitcher assembly 48 ineffective to feed wire when a group of sheets is rejected.

The control circuit 170 also includes a start switch 180. The start switch 180 is a double pole switch having two movable switch contacts, one designated 182 and the other designated 183. When the contacts 182 and 183 are closed, a circuit is completed from power line A to power line B through those contacts to energize inspector relays 190 and 191. When the relays 190 and 191 are energized, normally open contacts 190-1 and 191-1 thereof close. As a result, the relays 190 and 191 are maintained energized through switch contacts 192 and 193, respectively, of book inspector switch 195. The contacts 192 and 193 are normally closed.

Also, when the relays 190 and 191 are energized, normally open contacts 190-2 and 191-2 of the relays 190, 191 respectively are closed. This completes a circuit from conductor A to conductor B through those contacts 190-2 and 191-2 to the motor starter relay 200 which starts the machine.

The inspection switch 195 operates to determine when a book of correct thickness is being handled by the machine and when a book of incorrect thickness is being handled by the machine. When a book is being inspected switch contacts 192, 193 are opened. If a book of correct thickness is being handled by the machine, the normally open contact 201 of the inspection switch 195 will close while the normally closed contacts 202 will remain closed. Thus, the flow of current to the relays 190 and 191 will not be interrupted and the machine will continue to operate.

If an incorrect thickness book is detected by the inspector switch 195, when the contacts 192, 193 open one of the relays 190, 191 will be de-energized. If the book is thin, that is the book is of a thickness less than a predetermined thickness, the contact 201 will remain open and contact 202 will remain closed. If the book is too thick, the normally closed contacts 202 will be forced open and 201 will be forced closed. If the contact 201 remains open or the contact 202 opens, one of the inspector relays 190 or 191 will be de-energized. Relay 191 will be de-energized if the gather or book is too thin and relay 190 will be de-energized if the gather is too thick.

When a book which is too thin or too thick is sensed, further controls in the machine depend upon the positioning of a mode selector switch 210. The selector switch 210 has switch elements 213, 214 which are movable between three positions. In one position shown in full lines in FIG. 6, no books are rejected. When contacts 213, 214 are in position 210A, all books are rejected (all reject mode) and when contacts 213, 214 are in position 210B, books which are too thin or too thick are rejected (normal reject mode).

When the contacts 213, 214 of the selector switch 210 are in position 210A or 210B, current is supplied between the power line A and B to maintain the motor starter relay 200 energized. When the motor starter relay 200 was originally energized, the normally open motor starter relay contacts 200-1 were closed. Thus, when the contacts 213, 214 of switch 210 are in positions 210A or 210B, current flows from the power line A to the power line B through switch contact 213 and then through the now closed contacts 200-1 of the motor starter relay and through the motor starter relay 200. Thus, in the all reject or normal reject modes, the motor starter relay 200 is maintained energized due to the fact that there is no interruption of current to the motor starter relay. Thus, the machine continues to operate.

When the relays 190 and 191 were originally energized, normally closed relay contacts 190-3 and 191-3 thereof were opened. These contacts are located in parallel and in series with the clutch solenoid 174. Thus on original closing of switch 180, the clutch solenoid 174 could not be energized because these contacts, namely contacts 190-3 and 191-3, were opened.

However, when relay 190 or 191 is de-energized by current being interrupted due to contacts 201 or 202 of the inspector switch 195 being open, either contacts 190-3 or 191-3 will be closed. Closing of either of the contacts 190-3 or 191-3 causes an energization of the clutch solenoid 174 if the selector switch 210 is in the normal reject position 210B. Current will flow from the power line A through the contacts 213, 214 of the selector switch through the now closed but normally open contact 190-3 or 191-3, and through the clutch solenoid 174 to the power line B. This of course results in the shaft actuated by the clutch to rotate for a single revolution and of course results in operation of the reject ramp causing a rejection of the defective book.

Near completion of rotation of the one revolution of the clutch shaft a stop stitch switch designated 230 will be energized by a suitable mechanical mechanism actuated from rotation of the shaft. Specifically the switch 230 will be closed. When the switch 230 is closed, current will pass from the power line A through the selector switch 210 through the now closed switch 230 and to the solenoid 176 thus effecting energization of the solenoid 176. Energization of the solenoid 176 will also effect energization of a stop stitch holding relay 231. Energization of the relay 231 will cause normally open contacts 231-1 thereof to close. The relay 231 is in a series circuit with a cam operated normally closed microswitch 232. A current thus is completed through the cam operated switch 232, the now closed contacts 231-1 of the relay 231 and the relay 231. This results in the relay 231 remaining energized even though switch 230 opens and a disengagement of the wire draw in the stitcher head so as to cause no stitching to occur when the rejected gather would have been in the stitching cycle of operation in the machine.

In the event a correct thickness book is being handled by the machine, switch 230 will not be closed because clutch solenoid 174 will not rotate. Thus, a correct thickness book will be stitched.

When the stitching cycle is completed a cam not shown on the machine main drive shaft will cause the microswitch 232 to open. This de-energizes the holding relay 231 and thus the circuit will be ready for the next cycle of operation of the machine.

As noted above, one of the inspection relays 190, 191 are de-energized by the detection of an incorrect thickness book. Interposed between the relays 190 and 191 and a circuit 170 is a normally open microswitch 250. The normally open microswitch 250 is operated by a cam on the main drive shaft of the machine and is closed by the cam. When the switch is closed, a current is provided through the switch 250 to energize the de-energized relay 190 or 191. The switch 250 is closed at the appropriate time in the cycle of the machine so as to have the relay 190 or 191 energized so that the circuit is ready to inspect the next book.

During the interval between when the stop stitch solenoid 176 is energized and the holding relay 231 is energized, a cam (not shown) on the main drive shaft of the apparatus will close a normally open microswitch 260. Closing of the normally open microswitch 260 will send an impulse current to a counter (not shown) which counts the correct number of books delivered by the machine. The current to the counter travels through normally closed contacts 231-2 of the stop stitch holding relay 231 and switch 260. If the stop stitch holding relay 231 is energized indicating a gather has been rejected, the normally closed contacts 231-2 open interrupting the flow of current to the switch 260. Thus, an incorrect thickness book will not be counted.

In the event that for some reason, such as set up or otherwise, it is desired that no stitching of the book occur, the stop stitch solenoid 176 can be energized by manually closing normally open switch 270. When switch 270 is energized a current will flow to the stop stitch solenoid 176 and relay 231. As a result, stitching of the book will not occur.

Also, when the circuit is set up for a normal reject mode, a light 271 will be energized continuously through the contacts of the selector switch 210. Thus, the light 271 will indicate that books are being rejected in the normal reject mode (position 210B of the contacts 213, 214). When the selector switch 210 is in the all reject mode (position 210A of the contacts 213, 214), the light 271 will be energized through inspector switch contact 192 only when the machine is operating to inspect books. The switch contact 192 moves to close this circuit on each cycle, and thus during inspection the light 271 will operate periodically.

Also the circuit is constructed so that when the machine is in the no reject mode, namely the switch 210 is in the normal position shown in full line in FIG. 6, the machine will stop on a thin or thick book which is sensed by the inspector switch 195. Specifically, when the switch 210 is in the no reject mode and a double or miss is sensed, relay 190 or 191 is de-energized. When relay 190 or 191 is de-energized, relay contacts 190-2 or 191-2 are returned to their normal open position. When the contacts 190-2 or 191-2 return to their open position, the motor starter 200 stops, thus the machine stops. Accordingly, depending upon the position of the selector switch 210, the operation of the machine will vary.

Conclusion

In view of the foregoing description it is apparent that the collator 10 sequentially stitches groups 12 of sheets. The collator 10 includes a support surface which extends past a plurality of hoppers 14 to a stitching station 44. Sheets are sequentially fed from the hoppers 14 to form groups 12 of sheets on the support surface 16. A main conveyor assembly 24 sequentially pushes groups of sheets along the support surface 16 to a reject station 72. Groups of sheets containing more or less than a predetermined number of sheets are rejected at the reject station 72. The groups 12 of sheets containing the predetermined number of sheets are moved to a transfer station 32 where they are engaged by a secondary conveyor assembly 36 which moves them to a stitching station 44.

At the reject station 72, a ramp 84 is movable between a retracted position and an extended position. When the reject ramp 84 is in the retracted position, it cooperates with the main support surface 16 to support a group 12 of sheets containing the predetermined number of sheets as the group moves to the stitching station 44. When the ramp 84 is in the extended postion, it projects upwardly from the support surface 16 to the reject conveyor 94. The main conveyor 24 pushes groups 12 of sheets containing more or less than the predetermined number of sheets up the reject ramp 84 to the reject conveyor 94.

Having described one specific preferred embodiment of the invention, the following is claimed:

1. An apparatus comprising supply means for supplying sheets of material, support means extending along a path past said supply means to a stitching location, stitching means at said stitching location, means for feeding sheets from said supply means to form groups of sheets on said support means, reject means disposed along said path at a location between said supply means and said stitching location and operative to reject groups of sheets, said reject means including a reject ramp movable between a retracted position and an extended position wherein said reject ramp projects upwardly from said support means, and pusher means for normally sequentially pushing groups of sheets toward said stitching location when said reject ramp is in the retracted position and alternatively pushing groups of sheets onto said reject ramp when said reject ramp is in the extended position.

2. An apparatus as set forth in claim 1 wherein said reject ramp cooperates with said support means to sequentially support groups of sheets as they are being moved by said pusher means when said reject ramp is in the retracted position.

3. An apparatus as set forth in, claim 1 wherein said reject means includes conveyor means for engaging a leading end portion of, a group of sheets as it is pushed onto said reject ramp by said pusher means and for moving an engaged group of sheets toward a receiving location.

4. An apparatus as set forth in claim 1 further including control means operable between a first condition in which said reject ramp is continuously maintained in the retracted position, a second condition in which said reject ramp moles from the retracted position to the extended position only when said pusher means is moving a group of sheets to be rejected, and a third condition in which said reject ramp is continuously maintained in the extended position.

5. An apparatus as set forth in claim 1 further including transport means for clampingly engaging a group of sheets and moving it away from said reject means to the stitching location while holding the sheets in an engaged group of sheets against movement relative to each other.

6. An apparatus as set forth in claim 1 wherein said support means comprises a support surface said pusher means includes a continuous chain disposed beneath said support surface means, a plurality of pusher members connected to said chain and projecting above said support surface means, and drive means for moving said chain and pusher members to push groups of sheets, said reject ramp having an opening through which said pusher members can move when said reject ramp is in the extended position.

7. An apparatus as set forth in claim 6 wherein said reject means includes means for engaging a leading end portion of a group of sheets as it is pushed onto said reject ramp by one of said pusher members and for accelerating an engaged group of sheets to move it away from said one pusher member before said one pusher member moves through the opening in said reject ramp.

8. An apparatus comprising a plurality of hoppers for holding sheets of material, support surface means extending past said hoppers through a transfer station and a stitching station to a folding station, a plurality of sheet feeder means each of which is operable to transfer sheets of material from one of said hoppers to said support surface means to form groups of sheets on said support surface means, main conveyor means for sequentially moving groups of sheets to said transfer station, said main conveyor means including a plurality of pusher means each of which is engageable with a trailing edge portion of a group of sheets and drive means for moving said pusher means along said support surface means, secondary conveyor means for sequentially engaging and moving the groups of sheets from the transfer station to the stitching station and for sequentially moving groups of sheets from the stitching station to the folding station, stitcher means at the stitching station for sequentially stitching groups of sheets, folder means at the folding station for sequentially folding groups of sheets, said folder means including folder control means operable between a first condition in which said folder means sequentially folds groups of sheets moved to the folding station by said secondary conveyor means and a second condition in which said folder means is ineffective to fold groups of sheets, reject means disposed between said hoppers and the stitching station for rejecting a group of sheets containing more or less than a predetermined number of sheets prior to engagement of the group of sheets by said secondary conveyor means, said pusher means being operable to push a group of sheets containing more or less than the predetermined number of sheets into said reject means, said reject means including ramp means for supporting a group of sheets and means for moving a group of sheets supported by said ramp means away from said support surface means to a receiving location for rejected groups of sheets.

9. An apparatus as set forth in claim 8 wherein said ramp means extends upwardly from said support surface means, said pusher means being operable to push a group of sheets containing more or less than the predetermined number of sheets up said ramp means.

10. An apparatus as set forth in claim 9 wherein said means for moving a group of sheets supported by said ramp means includes means for engaging a leading end portion of a group of sheets being pushed up said ramp means by said pusher means and moving the engaged group of sheets away from said pusher means.

11. An apparatus as set forth in claim 8 wherein said ramp means is movable between a retracted position and an extended position, said ramp means having a side surface area which is disposed in a coplanar relationship with a side surface area of said support surface means when said ramp means is in the retracted position to at least partially support a group of sheets being moved by said main conveyor means, said side surface area of said ramp means extending transversely to the side surface area of said support surface means when said ramp means is in the extended position to enable said side surface area of said ramp means to support a group of sheets for movement along a path extending transversely to said support surface means.

12. An apparatus comprising a supply means for supplying sheets of material, a support extending along a path past said supply means to a stitching location, stitching means at said stitching location, means for feeding sheets from said supply means to form groups of sheets on said support, reject means disposed at a location between said supply means and said stitching location and operative to reject groups of sheets, said reject means including a reject ramp movable between a retracted position in which said reject supports said groups of sheets with said support means an extended position in which said reject ramp extend transversely to said support means, and means for sequentially moving groups of sheets along said path extending over said support surface and over said reject ramp toward said stitching location when said reject ramp is in the retracted position.

13. An apparatus as set forth in 12 wherein said reject means includes conveyor engaging a leading end portion of a group of sheet it moves along said reject ramp when said reject ramp the extended position and for moving an engaged group sheets toward a receiving location.

14. An apparatus as set forth in claim 12 further including control means operable between a first condition in which said reject ramp is continuously maintained in the retracted position, a second condition in which said reject ramp moves from the retracted position to the extended position only when said pusher means is moving a group of sheets containing more or less than a predetermined number of sheets, and a third condition in which said reject ramp is continuously maintained in the extended position.

15. An apparatus comprising supply means for supplying sheets of material, support means extending past said supply means to a stitching location, stitching means at said stitching location, means for feeding sheets from said supply means to form groups of sheets on said support means, reject means disposed along said support means at a location between said supply means and said stitching location for rejecting groups of sheets, said reject means including a reject ramp movable between a retracted position and an extended position projecting from said support means, means for sequentially pushing groups of sheets toward said stitching location when said reject ramp is in the retracted position and for pushing groups of sheets along said reject ramp when said reject ramp is in the extended position and control means operable between a first condition in which said reject ramp is continuously maintained in the retracted position, a second condition in which said reject ramp moves from the retracted position to the extended position only when said pusher means is moving a group of sheets containing more or less than a predetermined number of sheets along said support means, and a third condition in which said reject ramp is continuously maintained in the extended position.

16. An apparatus as set forth in claim 15 wherein said reject means includes conveyor means for engaging a leading end portion of a group of sheets as it is pushed along said reject ramp by said pusher means and for moving an engaged group of sheets toward a receiving location and which conveyor means operates only when said reject ramp is moved to its extended position.

17. An apparatus as defined in claim 15 wherein said control means includes sensor means for sensing the thickness of a group of sheets, means for stopping said machine upon said sensor means sensing a group of sheets having a thickness different than a predetermined thickness when said reject ramp is continuously maintained in the retracted position, and means for maintaining the machine operating when the reject ramp is maintained in its extended position or moves between its retracted and extended positions.

* * * * *

UNITED STATES PATENT AND TRADEMARK OFFICE

CERTIFICATE OF CORRECTION

PATENT NO. : 4,499,834

DATED : February 19, 1985

INVENTOR(S) : Rudolph H. Ruetschle & John W. Raker

It is certified that error appears in the above-identified patent and that said Letters Patent is hereby corrected as shown below:

Column 11, line 15, delete the comma (,) after "of";
line 23. change "moles" to -- moves --.

Column 12, line 57, after "reject" insert -- ramp --;
line 58, change "extend" to -- extends --;
line 65, after "conveyor" insert -- means for --;
line 66, change "sheet" to -- sheets-- and insert thereafter -- as --;
line 67, after "ramp" insert -- is in --.
Column 13, line 1, after "group" insert -- of --.

Signed and Sealed this

Sixth Day of August 1985

[SEAL]

*Attest:*

DONALD J. QUIGG

*Attesting Officer* *Acting Commissioner of Patents and Trademarks*